United States Patent [19]

Tajima et al.

[11] Patent Number: 4,876,574

[45] Date of Patent: Oct. 24, 1989

[54] DEVELOPING APPARATUS

[75] Inventors: Hatsuo Tajima, Matsudo; Takahiro Kubo, Tokyo; Hiroshi Tajika, Yokohama, all of Japan

[73] Assignee: Canon Kabushiki Kaisha, Tokyo, Japan

[21] Appl. No.: 266,810

[22] Filed: Nov. 3, 1988

[30] Foreign Application Priority Data

Nov. 4, 1987 [JP] Japan ..... 62-277346
Nov. 4, 1987 [JP] Japan ..... 62-277347
Nov. 4, 1987 [JP] Japan ..... 62-277348

[51] Int. Cl.[4] ..... G03G 15/08

[52] U.S. Cl. ..... 355/253; 355/245; 355/251; 355/261; 355/265

[58] Field of Search ..... 355/245, 251, 253, 261, 355/265

[56] References Cited

U.S. PATENT DOCUMENTS

| | | | |
|---|---|---|---|
| 4,192,604 | 3/1980 | Koyama | 355/251 |
| 4,297,970 | 11/1981 | Tajima et al. | 118/652 |
| 4,356,245 | 10/1982 | Hosono et al. | 430/122 |
| 4,377,332 | 3/1983 | Tamura | 355/3 DD |
| 4,383,497 | 5/1983 | Tajima | 118/651 |
| 4,387,664 | 6/1983 | Hosono et al. | 118/658 |
| 4,395,110 | 7/1983 | Hosono et al. | 355/3 DD |
| 4,444,864 | 4/1984 | Takahashi | 430/120 |
| 4,511,778 | 4/1985 | Takashi et al. | 355/FU X |
| 4,528,937 | 7/1985 | Kanno et al. | 355/251 X |
| 4,538,896 | 9/1985 | Tajima et al. | 355/3 R |
| 4,542,980 | 9/1985 | Tajima | 355/14 FU |
| 4,548,489 | 10/1985 | Yoshikawa | 355/3 DD |
| 4,555,172 | 11/1985 | Mogi | 355/251 X |
| 4,557,992 | 12/1985 | Haneda et al. | 355/251 X |
| 4,559,899 | 12/1985 | Kan et al. | 118/657 |
| 4,571,372 | 2/1986 | Urawa et al. | 430/122 |
| 4,575,220 | 3/1986 | Sakamoto et al. | 355/253 |
| 4,579,082 | 4/1986 | Murasawa et al. | 118/658 |
| 4,583,490 | 4/1986 | Kan et al. | 118/658 |
| 4,590,140 | 5/1986 | Mitsuhashi et al. | 430/102 |
| 4,607,938 | 8/1986 | Hosoi et al. | 355/3 DD |
| 4,615,608 | 10/1986 | Mizutani | 355/3 DD |
| 4,637,706 | 1/1987 | Hosoi et al. | 355/3 DD |
| 4,669,852 | 6/1987 | Tajima et al. | 355/3 DD |

FOREIGN PATENT DOCUMENTS

| | | |
|---|---|---|
| 62-96976 | 10/1987 | Japan . |
| 62-96977 | 10/1987 | Japan . |
| 62-96978 | 10/1987 | Japan . |
| 62-96979 | 10/1987 | Japan . |
| 62-96980 | 10/1987 | Japan . |

*Primary Examiner*—A. C. Prescott

*Attorney, Agent, or Firm*—Fitzpatrick, Cella, Harper & Scinto

[57] ABSTRACT

A developing apparatus in which toner and magnetic particles are supplied to a rotatable developing sleeve to which an elastic blade is contacted. Substantially only the toner is passed through the contact portion. At the free end portion of the elastic blade, the magnetic field is concentrated. The concentrated magnetic field confines the magnetic particles.

27 Claims, 6 Drawing Sheets

DEVELOPING APPARATUS

FIELD OF THE INVENTION AND RELATED ART

The present invention relates to a developing apparatus for developing an electrostatic latent image.

U.S. Pat. Nos. 4,548,489, 4,571,372, 4,579,082, 4,583,490, 4,607,938, 4,615,608 and 4,637,706 disclose a developing apparatus wherein magnetic particles and non-magnetic toner particles are contained in mixture in a container having an opening in which a rotatable developer carrying member is disposed, and wherein the mixed developer is in the container, but only the toner particles are carried out of the container and is further carried to a developing zone.

In those developing apparatuses, a developer particle confining member is disposed to the developer carrying member with a clearance therebetween, and a magnetic brush of the magnetic particles is formed by magnetic force provided by magnetic field generating means upstream of the magnetic particle confining member, by which the magnetic particles are confined within the container so that a thin layer of substantially only non-magnetic toner is formed on the developer carrying member. In order to prevent significant leakage of small size magnetic particles through the clearance between the confining member and the developer carrying member, a high precision is required in the position where the confining member is disposed and in the relative positional relation between the confining member and the magnetic pole providing the magnetic field. This makes the manufacturing difficult. On the other hand, in order to enhance the image quality, use of small diameter magnetic particles are desired.

U.S. Pat. No. 4,559,899 discloses that in addition to rotation of the developer carrying member, the magnet disposed therein is also rotated, by which the magnetic particles receive movement force in the direction opposite to that of the toner movement, by which the leakage of the magnetic particles out of the container is prevented. However, this complicates the structure of the apparatus.

U.S. Pat. Nos. 4,387,664, 4,356,245, 4,377,332 and 4,444,864 disclose that an elastic blade is press-contacted to the developer carrying member to a regulated thickness of the developer layer. However, those patents do not disclose as to the measure for preventing the leakage of the magnetic particles from the container.

Japanese Laid-Open Patent Applications Nos. 96976/1987 - 96980/1987 disclose a developing apparatus wherein an elastic blade is press-contacted to the developer carrying member, by which toner layer is passed, whereas the magnetic particles are prevented from leaking. However, in this measure, much load is applied from the elastic blade to the magnetic particles for the purpose of the mechanical confinement, which requires preciseness of the pressure under which the elastic blade is contacted. Therefore, the manufacturing of the devices is still difficult.

SUMMARY OF THE INVENTION

Accordingly, it is a principal object of the present invention to provide a developing apparatus which is simple in structure and in which toner and the magnetic carrier particles are applied on the rotatable developer carrying member, whereas substantially only the toner particles are conveyed to the developing zone.

It is another object of the present invention to provide a developing apparatus wherein small size magnetic particles can be prevented without difficulty, and substantially only the toner particles are conveyed to the developing zone.

It is a further object of the present invention, to provide a developing apparatus wherein substantially only the toner particles are conveyed to the developing zone, and wherein the amount of charge to the toner can be increased.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
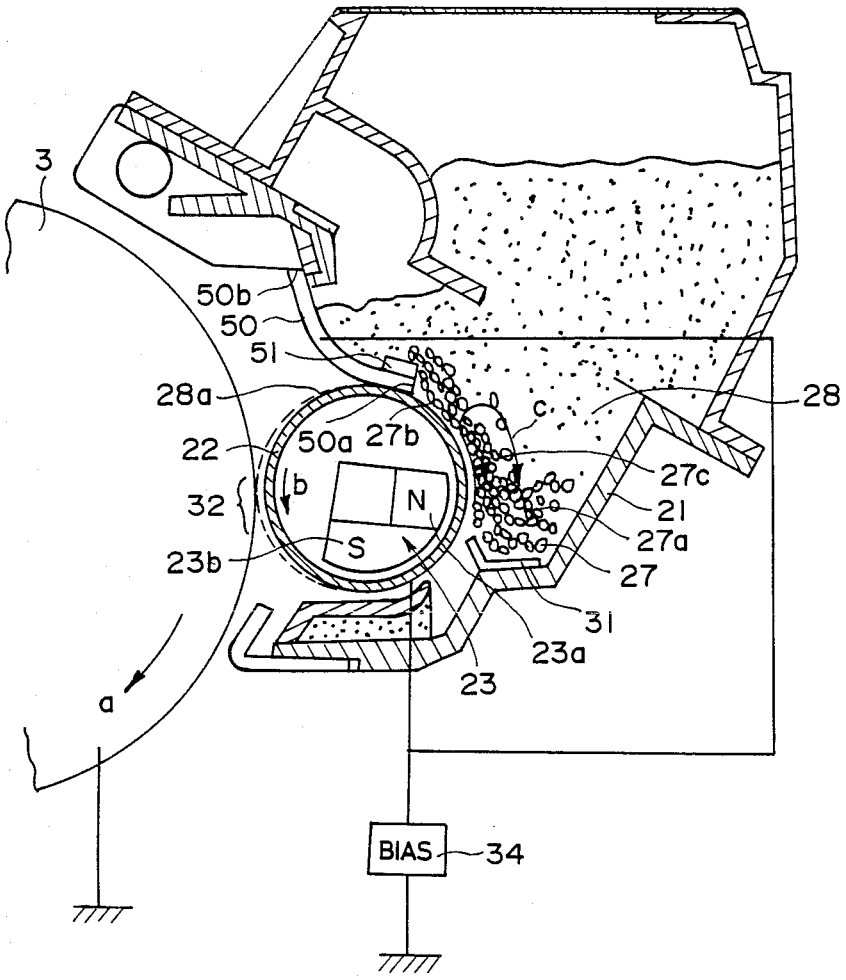
FIG. 1 is a sectional view of a developing apparatus according to an embodiment of the present invention.

Referring to FIG. 1, there is shown a developing apparatus according to an embodiment of the present invention wherein reference numeral 27 designates magnetic particles; and reference numeral 28, non-magnetic toner particles. The developing apparatus comprises a developer container 21 for containing magnetic particles 27 and non-magnetic toner particles 28 and comprises a developing sleeve 22 functioning as a developer carrying member. The developing sleeve 22 is a non-magnetic sleeve made of, aluminum or the like. The container 21 has an elongated opening formed in a left, in the Figure, wall thereof extending perpendicularly to the sheet of the drawing. The developing sleeve is in the opening with its substantially half periphery thereof being in the container 21 and with its substantially left half being exposed outside the container. The sleeve is supported for rotation in the counterclockwise direction b as shown by an arrow in the Figure. The developer carrying member is not limited to such a cylindrical member (sleeve), but it may be in the form of a rotatable endless belt A conductive rubber roller is also usable. The exposed surface of the developing sleeve 22 is contacted, or opposed with a small clearance, to a surface of a latent image bearing member 3 such as an electrophotographic photosensitive member or the like at a developing zone 32, the latent image bearing member 3 being rotatable in the direction indicated by an arrow a. In the developing sleeve 22, a permanent magnet (magnetic field generating means) 23 is disposed stationarily in the position and pose as shown. The magnet 23 is provided with two magnetic poles, N pole 23*a* and S pole 23*b*. The permanent magnet may be replaced with an electromagnet.

Toner layer forming means includes a non-magnetic elastic member 50 in the form of a blade and a magnetic member 51 to form on the sleeve 22 a layer of toner particles 28*a* in the developing zone 32 where the toner is transferred to the photosensitive member to develop the electrostatic latent image.

The magnetic blade 50 is fixed to the container 21 adjacent its one side 50*b* by a bonding agent or by screws. The free end 50*a* thereof is urged to the sleeve 22. Here, "urge" means that the blade is directly contacted resiliently to the sleeve if there is no developer therebetween, but the blade resiliently urges the thin layer of the developer to the sleeve if there is the developer therebetween. Usually, such a state is called "urged" irrespective of the presence of the developer between the sleeve and the blade, and therefore, it is stated "urged" in this specification.

As will be understood from the drawing, the blade 50 is oriented counter-directionally with respect to the rotational direction of the sleeve 22 and is urged to the surface of the sleeve 22. In other words, the free end 50*a* is disposed upstream of the fixed end of the blade 50. The counter-directional contact of the blade 50 to the sleeve 22 is preferable because the mechanical prevention of the magnetic particles 27 from passage is enhanced. Further, it is preferable, as is the case in each of the following embodiments, that between the free end edge of the blade 50 and the sleeve 22, a small clearance or gap d is formed in order make it easy for the toner to reach the nip between the sleeve 22 and the blade 50. In order to assure the entrance of the magnetic particles into the gap d, the size of the gap is smaller than an average diameter r of the magnetic particles. However, this is not inevitable. For example, if the surface of the blade 50 faced to the sleeve 22 at the free end side is contacted to the sleeve such that the anti-node or convex side of the blade is contacted to the sleeve, the edge of the blade at the free end may be lightly contacted to the sleeve According to this embodiment, the magnetic particles are magnetically confined at the free end side of the blade, and therefore, the magnetic particle preventing effect is high even if the gap d is larger than the average particle size of the magnetic particles.

Along the axis of the sleeve 22, more particularly, along the contact area between the blade 50 and the sleeve 22, an elongated magnetic member 51 is bonded to the upper surface of the blade 50 adjacent the free end 50*a* thereof. The magnetic member 51 is disposed in the influence of the magnetic field formed by the magnetic pole 23*a*. Since the magnetic pole 23*a* is disposed upstream of the free end of the blade 50 and the magnetic member 51 with respect to the rotational direction of the sleeve, the magnetic lines of force extending from the magnetic pole 23*a* are concentrated on the magnetic member 51 with quite inclinedly relative to the sleeve 22 surface. The concentrated magnetic field to the magnetic member 51 magnetically confines the magnetic particles.

As described, by the contact or press-contact of the elastic blade 50 having the magnetic member 51 to the sleeve, the leakage of the magnetic particles can be substantially completely prevented. This is because not only the confining force by the magnetic field between the magnetic member 51 and the magnetic pole 23*a* but also the mechanical confining force by the non-magnetic elastic blade 50 are effective to the leakage prevention. If the magnetic member 51 is not provided, the magnetic particles tend more to enter the nip between the blade 50 and the sleeve 22 with the rotation of the sleeve 22. However, according to this embodiment, the tendency is eased by the magnetic confining force, and therefore, the duty of the blade 50 to the magnetic particle confinement is reduced, so that substantially only the toner particles are discharged through the nip formed between the blade 50 and the sleeve 22. The toner having passed through the nip is retained on the sleeve 22 by electrostatic image force and is carried to the developing zone. Therefore, as shown in FIG. 1, there is no magnetic pole for conveying the magnetic particles between the nip and the developing zone 32.

As for the elastic blade 50, a rubber blade made of urethane rubber, nitrile rubber, silicone rubber, fluorine rubber or the like having a thickness of 0.5–3.0 mm, JIS A hardness of 30–90 degrees, is preferable. Further it is preferable that the blade is contacted to the sleeve with the line pressure of 20–200 g/cm along the length of the sleeve. Another usable material for the elastic blade is a metal leaf spring such as phosphor bronze or the like or a synthetic resin sheet such as polyethylene terephthalate or the like. As for the magnetic member 51, ferromagnetic material such as iron can be used, and the thickness thereof is preferably 0.5–2.0, and the width thereof is not less than 4.0 mm, but this is not limiting.

Figure 2:
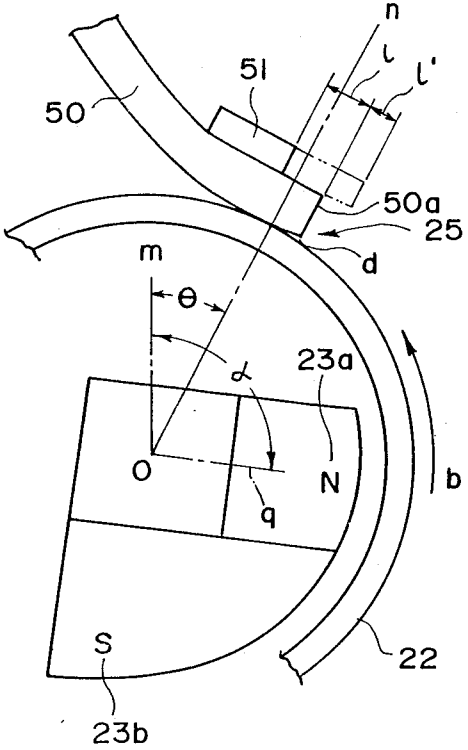
FIG. 2 is a sectional view of a major part of a developing apparatus according to an embodiment of the present invention.

As shown in FIG. 2, the distance 1 between the free end 50*a* of the elastic blade 50 and the leading edge of the magnetic member 51 is preferably not more than 5 mm, and further preferably not more than 3 mm. If the distance l is larger than 5 mm, the magnetic field tends more to easily pass the magnetic particles adjacent the free end of the elastic blade, and therefore, the duty of the elastic blade 50 for the mechanical confining effect is increased. This results in smaller latitude in the setting conditions of the elastic blade.

As regards the distance from the blade free end 50*a* to the end of the magnetic member 51 at the downstream with respect to the rotational direction of the sleeve, the leading end of the magnetic member 51 may be projected out toward upstream from the free end 50*a* of the elastic blade with respect to the rotational direction of the sleeve.

The distance l′ of projection is not more than 10 mm, and preferably not more than 8 mm. If the distance l′ is beyond 10 mm, a circulating movement, which will be described hereinafter, of the magnetic particles stopped by the free end 50*a* of the elastic blade is suppressed, and therefore, the magnetic particles are strongly packed adjacent the free end of the blade 50*a*. Therefore, in order to prevent the leakage of the magnetic particles, the mechanical confining force to the magnetic particles by the nonmagnetic blade 50 has to be increased, and therefore, it is not preferable in that it makes the magnetic elastic blade 50 setting conditions more difficult.

By the magnetic field between the magnet 23 and the magnetic member 51 mounted to the elastic blade 50, a great amount of non-magnetic toner is stagnated outside a layer of magnetic particles (first layer) on the sleeve 22 in the developer container, constituting a second layer. In the magnetic particle layer adjacent the sleeve surface at a position corresponding to the magnetic pole 23*a* of the magnet 23, a magnetic brush 27*a* of the magnetic particles is formed by the strong magnetic field provided by the magnetic pole 23*a*.

The magnetic particle layer adjacent the free end of the non-magnetic elastic blade (magnetic particle confining member) constitutes a substantially stationary layer 27*b* which is slightly movable but substantially stationary and which is confined at a position indicated by a reference 25 on the surface of the sleeve 22 due to the balance between the conveying force in the direction of the movement of the developing sleeve 22 and the confining force provided by the gravity, the magnetic force and the presence of the magnetic member 51.

By rotating the developing sleeve 22 in the direction indicated by an arrow b, the magnetic brush 27*a* circulates in the direction c adjacent the magnetic pole 23*a*, and constitutes a circulating layer 27*c* (FIG. 1). In the circulating layer 27*c*, the magnetic particles relatively close to the developing sleeve 22 bulges as a whole by the rotation of the developing sleeve 22 from adjacent the magnetic pole 23*a* toward the downstream with respect to the rotational direction of the sleeve. That is, they receive upward force. The magnetic particles having been moved up fall by the gravity and return to the neighborhood of the magnetic pole 23*a*. Thus, in the circulation layer 27*c*, the magnetic brush 27*a* of the magnetic particles circulates in the direction c by the gravity, the magnetic force provided by the magnetic pole, the frictional force and the fluidability of the magnetic particles. During the circulation, the magnetic brush takes thereinto the non-magnetic toner 28 from the toner layer on the magnetic particle layer sequentially and returns to the bottom position of the developer container 21, and the circulation is repeated together with the rotational drive of the developing sleeve 22. By the circulating movement of the magnetic particles, the toner taken into the layer is triboelectrically charged by the friction with the magnetic particles and is retained on the sleeve 22. The toner layer is returned on the sleeve surface into the container after being subjected to the developing operation, and the toner layer is stirred. The stirring is contributable to erasure of the development hysteresis remaining in the returned toner layer.

The provision of the magnetic member 51 makes easier the concentration of the magnetic field by the magnetic pole 23*a* on the neighborhood 50*a* of the free end of the elastic blade 50, as compared with the case where there is not provided the magnetic member 51, and therefore, the magnetic particle retaining force is increased adjacent the free end so that the triboelectric charge application to the non-magnetic toner 28 is increased, simultaneously, the non-magnetic toner particles 28 are prevented from being directly brought to the sleeve surface without being contacted to the magnetic particles from the neighborhood of the free end of the elastic blade 50 having the magnetic member, so that the foggy background and the sleeve ghost are prevented from occurring. Since, due to the magnetic field, the magnetic particles are retained uniformly along the length of the developing sleeve 22 by the magnetic confining force adjacent the elastic blade free end, the non-magnetic toner particles 28 can be coated without non-uniformity on the developing sleeve 22 surface. Further, by projecting the end of the magnetic member 51 beyond the free end of the non-magnetic blade 50 toward the upstream of the sleeve rotational direction, the circulation can be improved.

By disposing a magnetic member in this manner, the non-magnetic developer 28 is prevented from being directly brought from the above position to the feed end 25 of the elastic blade, whereby a good image without foggy background and sleeve ghost can be provided.

An example of the developing apparatus shown in FIG. 1 will be described. The developer carrying member 22 was made of aluminum sleeve having a diameter of 20 mm with a surface sandblasted with ARANDOM particles having non-spherical shapes. The magnet 23 had two magnetic poles, one 23*a* of which was N pole providing approximately 750 Gausses, and as shown in FIG. 2, which was disposed such that an angle $\alpha$ formed between a line q passing through the center of the N pole 23*a* and the sleeve center O and a vertical line m passing through the center O of the sleeve was 95 degrees. When the magnetic pole 23*a* was modified such that it provided 1000 Gausses, the circulation in the direction c in FIG. 1 was approximately doubled The non-magnetic elastic blade 50 was made of urethane rubber having a thickness of 2 mm and a hardness of 60 degrees The magnetic member 51 was made of a steel plate having a thickness of 1 mm which was chemically plated with nickel The steel plate is preferably made of SPC steel plate, Si steel plate, permalloy or the like. The magnetic member may be magnetized to strengthen the magnetic field in the tangential direction of the sleeve. The magnetic member 51, as shown in FIG. 1, was disposed so that it was away by a distance l (2 mm) from the free end of the non-magnetic elastic blade 50. In the apparatus shown in FIG. 1, an angle $\theta$ (FIG. 2) formed between a line l connecting the center of the sleeve O and the contact portion (nip) between the sleeve and the blade and the line m was 30 degrees.

Almost all of the magnetic particles had the particle sizes 63–44 microns (250/350 mesh) with the center of the particle size distribution of 53 microns. The magnetic particles were of ferrite particles (maximum magnetization: 65 emu/g) coated with mixture resin of acryl and fluorine. The non-magnetic toner powder was of toner particles having an average particle size of 12 microns containing 100 parts of styrene/butadiene copolymer resin and 5 parts of copper phthalocyanine pigment added by 0.6% of colloidal silica. The toner used was blue toner A good coating substantially of toner particles was obtained on the sleeve having a thickness of approximately 30–50 microns with triboelectric charge amount of +15 microCoul/g which was measured by a blow-off method.

Referring to FIG. 1, the bias source 34, in this example, provided a voltage which was a superposition of a DC voltage of −300 V and an alternating voltage having a frequency of 1600 Hz and a peak-to-peak voltage of 1300 V. This voltage was added to the sleeve 22 to form a vibratory electric field in the developing zone. By the vibratory electric field, the toner particles reciprocated in the developing zone between the sleeve and the photosensitive member, whereby the toner was deposited on the image area of the electrostatic latent image. A good blue image was obtained when the developing operation was performed with the distance between the developing sleeve 22 and the OPC photosensitive member 3 being 300 microns.

The present invention can be embodied when the magnetic member is magnetic field generating means.

Figure 3:
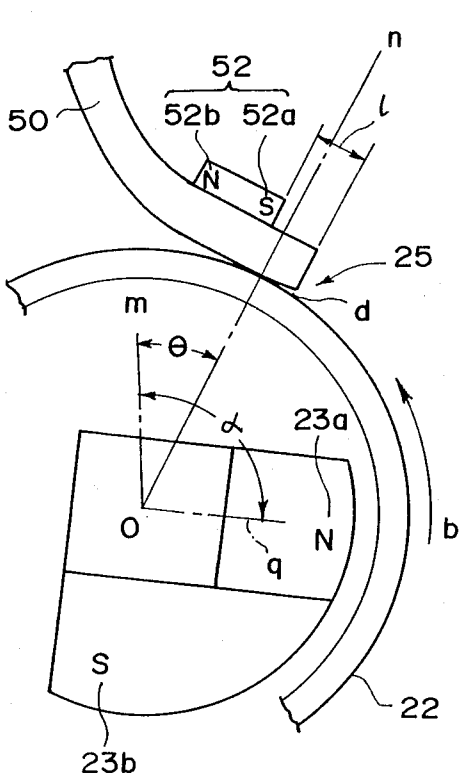
FIG. 3 is a sectional view of a major part of a developing apparatus according to another embodiment of the present invention.

Referring to FIG. 3, there is shown an embodiment in this form. As shown in this Figure, a magnetic member 52 functioning as the magnetic field generating means is a permanent magnet having two poles in this embodiment. As shown in FIG. 3, S-pole 52*a* side of the magnet (the polarity opposite to the N-pole of the magnetic pole 23*a*) is disposed close to the free end of the non-magnetic elastic blade 50, by which the magnetic field formed between the magnetic pole 23*a* and the magnetic pole 52*a* can be further strengthened. Therefore, the retaining the confining force to the magnetic particles 28 adjacent the point 25 are increased. This enhances the triboelectric charge application power to the non-magnetic developer 27, and simultaneously, eases the mechanical setting conditions of the non-magnetic elastic blade 50.

Figure 4:
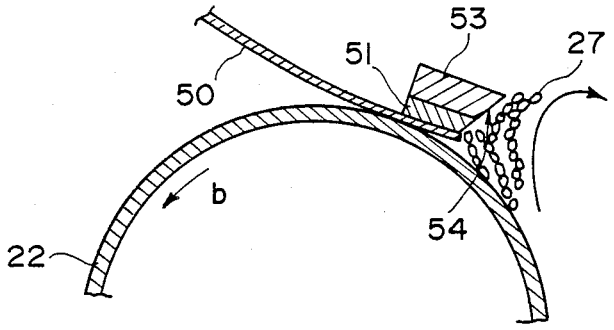
FIG. 4 is a sectional view of a major part of a developing apparatus according to a further embodiment of the present invention.

Referring to FIG. 4, there is provided a magnetic particle guiding member mounted on the magnetic member 51. The member 53 and the magnetic member 51 form a block member having a front surface 54 functioning as a magnetic particle guiding surface extending from the free end of the elastic blade 50 an inclined toward upstream with respect to the rotational direction of the sleeve. The member 53 is made of a non-magnetic material.

Figure 5:
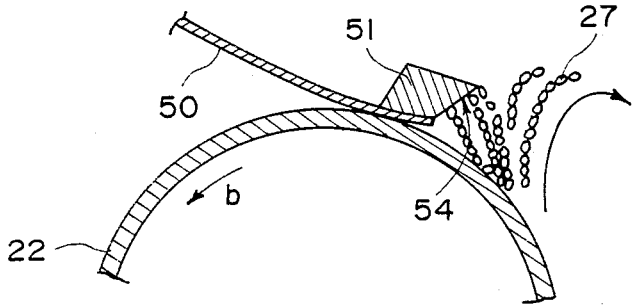
FIG. 5 is a sectional view of a major part of a developing apparatus according to a further embodiment of the present invention.

In FIG. 5, the magnetic particle guiding surface 54 is disposed at the front surface of the magnetic member 51. When the magnetic particle conveying force by the sleeve 22 is strong, the magnetic particles receive high pressure toward the free end surface of the elastic blade 50 and the front surface of the magnetic member, and therefore, they are urged into the nip formed between the blade 50 and the sleeve 22, which results in varied pressing force between the sleeve and the blade, and therefore, the thickness of the toner layer is varied. In this case, by the provision of the guiding surface 54 shown in FIGS. 4 and 5, the magnetic particles are moved by the guiding surface 54 upwardly and away from the developing sleeve 22, and thereafter, move down by the gravity, and return toward the neighborhood of the magnetic pole 23*a*. In this manner, the magnetic particles are smoothly circulated as indicated by an arrow C in the Figure, and therefore, the wedge-shaped space between the free end side of the elastic blade and the sleeve is not plugged Therefore, the elastic member is capable of conveying the toner to the developing zone always with a uniform thickness, because the press-contact force between the sleeve and the elastic member is not increased improperly, and because no clearance is formed. Also, the circulation is as good as predetermined, and therefore, the toner receives sufficient triboelectric charge amount which is sufficient, stabilized and uniform.

A magnetic member 51 is mounted adjacent the free end of the elastic blade 50, and the magnetic member 51 is disposed in the magnetic field by the magnetic pole 23*a*, and therefore, the free end side of the elastic blade 50 is attracted to the sleeve 22 uniformly along the length of the sleeve by the magnetic force. By this, the mechanical setting conditions or requirement with respect to the blade 50 are eased.

Figure 6:
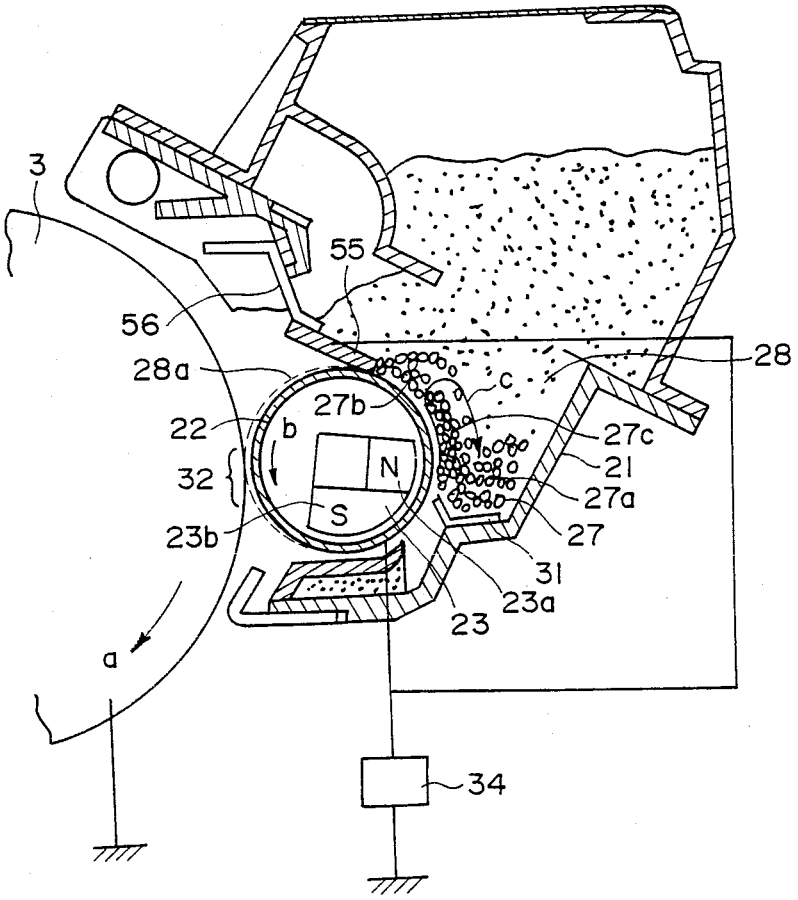
FIG. 6 is a sectional view of a developing apparatus according to a further embodiment of the present invention.

The following embodiment employs an elastic blade which itself has magnetic properties. In FIG. 6, an elastic blade 55 has magnetic properties and is mounted to a holder 56 fixed to the container 21 at its one end by a bonding agent, screws or the like. The elastic blade 55 similarly to the blade 50, has a free end surface opposed to the sleeve 22 and is resiliently contacted to the sleeve 22.

Figure 7:
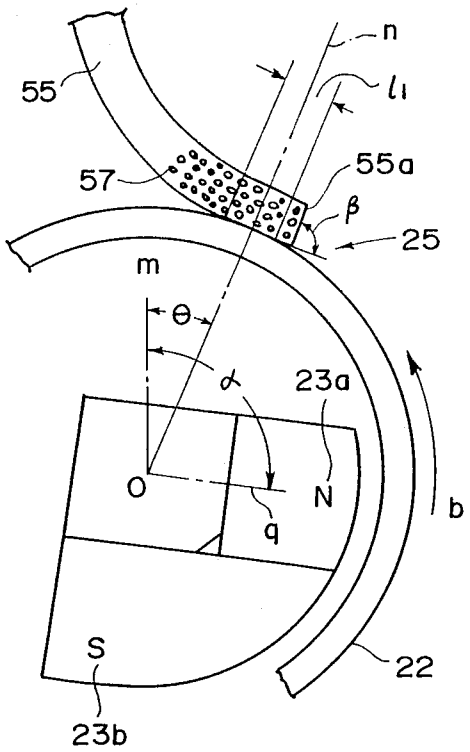
FIG. 7 is a sectional view of a major part of a developing apparatus according to a further embodiment of the present invention.

As shown in FIG. 7, at least that portion of the elastic blade 55 which is adjacent to its free end 55*a* contains fine magnetic particles 57 dispersed therein. The portion of the blade 55 containing the magnetic particles 57, that is, the magnetic portions of the blade 55 is disposed in the magnetic field formed by the magnetic pole 23*a*. Therefore, the magnetic lines of force extending from the magnetic pole 23*a* are concentrated on the free end side of the blade 55, so that the concentrated magnetic field is formed similarly to the above. The concentrated magnetic field is effective to confine the magnetic particles adjacent the free end 55*a* of the blade 55.

As described in the foregoing, when the elastic blade 55 having the magnetic property is contacted or press-contacted to the developing sleeve 22, the leakage of the magnetic particles are substantially completely prevented, and therefore, substantially only the toner particles can be conveyed to the developing zone. The reason for this is that not only the confining force due to the magnetic field between the magnetic pole 23*a* and the magnetic portion 55 but also the mechanical confining force by the elastic blade 55 are applied to the magnetic particles. In this manner, the duty of the blade 55 for mechanically confining the magnetic particles is reduced. By the magnetic particles thus confined magnetically, the triboelectric charge to the nonmagnetic toner is increased, and the toner is uniformly applied on the sleeve 22.

The elastic blade 55 is made of urethane rubber having a thickness of 0.5–3.0 mm and the hardness of 30–90 degrees (JIS-A) into which 10–90 parts by weight of magnetic particles mixed thereinto. This is a preferable elastic blade 55 of this embodiment. It is preferable that the blade 55 is press-contacted to the sleeve 22 under a line pressure of 20–200 g/cm along the length of the sleeve 22, that is, the length of the nip between the sleeve 22 and the blade 55. As regards the width $l_1$ (FIG. 7) of the nip, it is not more than 5 mm, preferably, not more than 3 mm. If it is larger than 5 mm, the mechanical confining force acts on the toner particles so strongly that the passage of the toner particles are obstructed, and in addition, excessive triboelectric charge is applied to the toner, both of which may be causes of a poor quality of the image. Since the magnetic attracting force applied between the magnetic pole 23*a* and the magnetic members 57 dispersed in the elastic blade 55 is effective to attract the blade to the sleeve, and therefore, the latitude in the design of the blade 55 contact and the rubber material is expanded, whereby the blade can be uniformly contacted in the longitudinal direction. In the embodiment of FIG. 6, the movement of the magnetic particles and toner particles in the container 21 is similar to that of FIG. 1 embodiment.

An actual example of the developing apparatus according to FIG. 6 embodiment will be described. The developer carrying sleeve 22 was made of aluminum sleeve having a diameter of 20 mm and having a surface sand-blasted with Arandom non-spherical abrasive particles. The magnet 23 had two magnetic poles (N and S). The N pole 23a provided a magnetic flux density of approximately 750 Gausses, and was disposed to provide the angle $\alpha$ of 95 degrees, as shown in FIG. 7. When the magnetic pole 23a was made 1000 Gausses, the circulation in the direction C in FIG. 6 was approximately doubled.

The cut angle $\beta$ at the free end edge of the blade, that is, an angle formed between the free end surface and the bottom surface contacted to the sleeve is not less than 60 degrees, preferably, not less than 90 degrees, as shown in FIG. 7. If it is smaller than 60 degrees, the developer stagnates adjacent the blade free end with the result of non-uniform coating (producing white stripes in the developed image) and fusion of the toner onto the sleeve if the toner is capsuled toner.

Almost all of the magnetic particles had the particle sizes 63–44 microns (250/350 mesh) with the center of the particle size distribution of 53 microns The magnetic particles were of ferrite particles (maximum magnetization: 65 emu/g). The non-magnetic toner powder was of toner particles having an average particle size of 12 microns containing 100 parts of styrene/butadiene copolymer resin and 5 parts of copper phthalocyanine pigment added by 0.6% of colloidal silica The toner used was blue toner. A good coating substantially of toner particles was obtained on the sleeve having a thickness of approximately 30–50 microns with triboelectric charge amount of +15 microCoul/g which was measured by a blow-off method.

Referring to FIG. 6, the bias source 34, in this example, provided a voltage which was a superposition of a DC voltage of −300 V and an alternating voltage having a frequency of 1600 Hz and a peak-to-peak voltage of 1300 V. This voltage was added to the sleeve 22 to form a vibratory electric field in the developing zone. A good blue image was obtained when the developing operation was performed with the distance between the developing sleeve 22 and the OPC photosensitive member 3 being 250 microns The material of the blade 55 may be silicone rubber, fluorine rubber or the like as well as the urethane rubber The magnetic material dispersed and mixed into the rubber material may be fine ferromagnetic particles such as iron powder, magnetite powder and permalloy powder. Such magnetic materials may be dispersed in the entire body of the blade.

Figure 8:
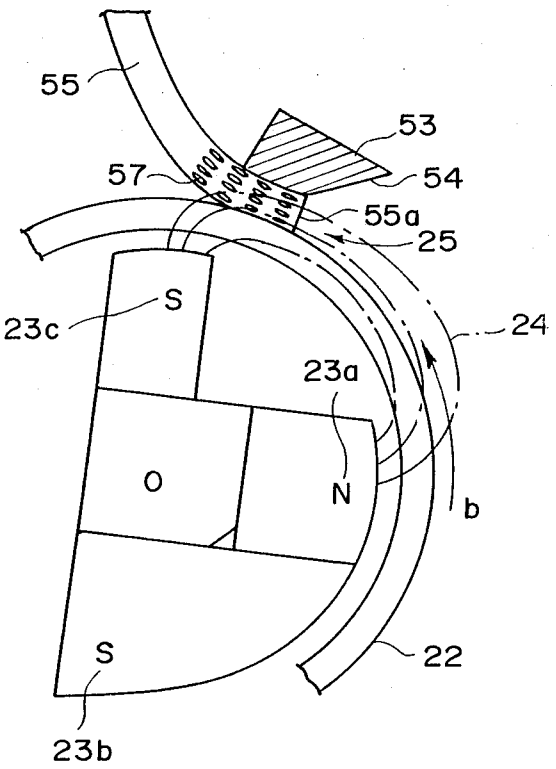
FIG. 8 is a sectional view of a major part of a developing apparatus according to a further embodiment of the present invention.

Referring to FIG. 8, another embodiment will be described. The elastic blade 55 contains magnetic particles 57 which have a magnetic anisotropy in the direction substantially parallel to the magnetic lines of force 24 formed between the magnetic pole 23a and the magnetic pole 23c disposed downstream of a contact position between the sleeve and the blade with respect to the rotational direction of the sleeve In this embodiment, the configurational magnetic anisotropy is used. The magnetic pole 23c is not inevitable, but it is provided because with the magnetic pole 23c the magnetic lines of force can be made substantially parallel to the surface of the sleeve. The circulation of the magnetic particles in the container is enhanced by the magnetic pole 23c, and the triboelectric charge application to the toner is enhanced The guiding member 53 is provided to guide the developer.

By disposing in the elastic blade magnetic members providing magnetic anisotropy along the magnetic lines of force, the magnetic lines are concentrated more strongly on the elastic blade, and therefore, more uniform magnetic brush of magnetic particles is formed at the free end of the blade so that the toner particles are more uniformly applied on the sleeve. The developer guiding member 53 is effective to promote the circulation of the magnetic particles so that the toner is taken into the magnetic particle layer more uniformly. Also, the triboelectric charging friction between the toner and the sleeve 22 becomes more efficient to enhance the triboelectric charge application to the toner.

In each of the above-described embodiments, conductive particles such as carbon or the like may be mixed into the elastic blade to reduce the electric resistance to prevent accumulation of the triboelectric charge due to the friction with the toner, by which the frictional charge application to toner can be further stabilized. In this case, it is preferable that the power source 24 applies to the elastic blade the same voltage as to the sleeve, so that the potentials of the blade and the sleeve are the same. When the blade is made of metal plate, it is preferable that the potentials of the blade and the sleeve are the same, similarly.

Figure 9:
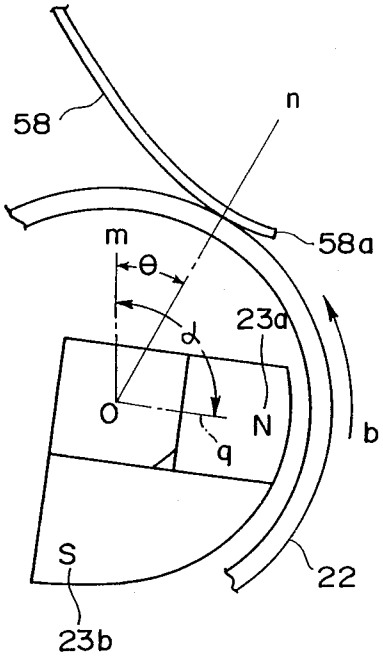
FIG. 9 is a sectional view of a major part of a developing apparatus according to a further embodiment of the present invention.

FIG. 9 shows an embodiment wherein the elastic blade is made of magnetic metal thin plate 58. More particularly, it may be made of a steel plate having a thickness of approximately 25 microns and chemically plated with nickel with a uniform small thickness. With the arrangement shown in FIG. 9, the magnetic field between the free end of the magnetic elastic member 58 and the magnetic pole 23a is concentrated on the free end portion because the thickness of the magnetic elastic member 58 is small, whereby the confining force by the magnetic particles can be increased. By this, the mechanical setting conditions or requirements of the magnetic elastic member 58 are eased, and therefore, it is preferable.

When the metal elastic member is used, the wearing due to the rubbing between the metal elastic member and the sleeve is stimulated, and therefore it is preferable that a soft elastic member such as rubber and synthetic resin is used for the surface of the metal elastic member which is press-contacted to the sleeve.

Figure 10:
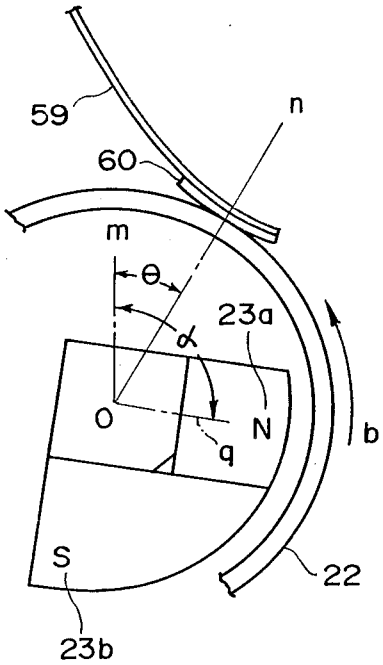
FIG. 10 is a sectional view of a major part of a developing apparatus according to a further embodiment of the present invention.

FIG. 10 shows an embodiment in this form. As shown in this Figure, a thin plate 60 of soft elastic material such as urethane rubber or the like is bonded to that side of the elastic plate 59 which is opposed to the sleeve 22, the elastic blade 59 being made of non-magnetic metal such as phosphor bronze or ferromagnetic metal such as iron, and the elastic plate 60 is press-contacted to the sleeve by the resilient force provided by the metal elastic plate 59. In FIG. 10, the elastic plate 60 is provided only at and adjacent the contact portion with the sleeve, but it may be bonded to the entire bottom surface of the elastic plate 59.

The toner may have a usual particle size such as 5–20 microns. The average particle size of the magnetic particles 27 is preferably larger than that of the toner particles, more particularly, it is 30–200 microns, and further preferably 40–70 microns.

The image quality is improved with decreased particle size of the magnetic particles, and the production of foggy background and the sleeve ghost can be particularly reduced. This is because with the increase of the particle size, the specific surface area increases, and the degree of contact with the other materials is increased, so that the triboelectric charge application to the toner by the magnetic particles is increased. On the contrary, if the particle size of the magnetic particles is too large, the foggy background or the sleeve ghost are sometimes produced.

However, when the particle size is small, the magnetic confining force by the magnetic field is reduced, and the magnetic particles become easily leaked out of the container. Therefore, the particle size of the magnetic particles is preferably as small as possible, provided that the magnetic particles are substantially leaked out of the container. From this standpoint, accurate classification is desirable Ferrite magnetic particles were produced with silicone resin coating through a known method and were classified using a standard screen defined in JIS-Z 8801. Then, a particle size distribution was determined by particle size distribution determination method in accordance with JIS-H 2601. The magnetic particles were classified in five classes by the boundaries of 145 mesh, 250 mesh, 350 mesh and 400 mesh. Those were mixed and were used in the apparatus. The following is confirmed:

(1) In order to sufficiently prevent the leakage of the magnetic particles, the content of the particles having a diameter smaller than that corresponding to 400 mesh is preferably not more than 10% by weight.

(2) In order to eliminate the production of the sleeve ghost (an image having been developed appears in the next developed image), the particles having a diameter larger than that corresponding to 145 mesh are excluded as much as possible, and the average peak particle size is 250–350 mesh is preferable.

(3) The foggy background is hardly produced even if approximately 50% having the relatively large particle size of 145–250 mesh is contained. This means that the foggy background is not produced according to this invention, even under the condition that insufficient (resulting in foggy background production) triboelectric charge application is made to the toner to apply the triboelectric charge to the toner on the developing sleeve by rubbing it by the elastic blade.

Each of the magnetic particles 27 may be made only of the magnetic material or, may be a combination of magnetic material and non-magnetic material such as synthetic resin or the like, or may be a mixture of two kinds of magnetic particles. The magnetic material usable for the magnetic particles is ferromagnetic material such as ferrite, magnetite and iron powder.

In the foregoing embodiment, a non-magnetic toner is used, but a magnetic toner is usable if the magnetic properties thereof is very weak as compared with the magnetic particles, and if it is triboelectrically chargeable.

If the surfaces of the magnetic particles 27 are made insulative by coating with oxide film or resin having the same electrostatic level as the non-magnetic developer so that the triboelectric application from the magnetic particles to the toner is reduced and that the necessary triboelectric charge to the toner is mainly given from the developing sleeve 22, the deterioration of the magnetic particles 27 can be suppressed, and the toner application to the developing sleeve 22 is stabilized. Since the toner to be charged is non-magnetic and therefore is not confined by the magnetic field of the magnetic pole 23*a*, and it is applied on the surface of the developing sleeve as a uniformly thin layer by image force during the sleeve surface moving from the magnetic member 31 adjacent the bottom edge of the container opening to the free end of the elastic blade. In this case, the major functions of the magnetic particles are to take the toner from the toner layer and convey to the surface of the sleeve and to destroy the hysteresis remaining in the thickness of the toner layer on the sleeve surface by stirring the toner layer. Although the toner is not sufficiently triboelectrically charged by the magnetic particles, the sufficient triboelectric charge is given to the toner since the toner is strongly rubbed with the sleeve by the elastic blade.

The material of the elastic blade has preferably a position in the triboelectric charge series away from that of the toner so as to provide the toner with the predetermined charging polarity for developing the electrostatic latent image. The triboelectric charge application to the toner may be further enhanced by roughening the surface of the elastic blade contactable to the developing sleeve.

According to the present invention, a thin toner layer can be formed, and therefore, it is particularly usable with an apparatus for developing a latent image using a toner layer having a thickness smaller than the clearance between the developing sleeve and the electrostatic latent image bearing member. However, the present invention is still applicable to a developing apparatus wherein the clearance is smaller than the thickness of the developer layer.

Also, the present invention is applicable to a developing device wherein the toner can be replenished by, for example, using a toner replenishing cartridge.

Since the present invention uses a toner layer forming means having an elastic blade and a magnetic member or a toner layer forming means having magnetic elastic blade, the magnetic particles are confined stably and can be uniformly circulated in the container. By the magnetic field concentration at the free end of the elastic blade, the confining force to the magnetic particles is increased, by which a great amount of the magnetic particles can be uniformly retained adjacent the free end of the elastic blade, and therefore, the triboelectric application to the toner is enhanced. As a result, a thin toner layer having a uniform layer thickness and having a uniform and sufficient amount of charge can be produced in a stabilized manner and for a long period of time, using only a small amount of magnetic particles. The same advantageous effects can be provided when non-magnetic fine particle toner having a particle size of not more than 10 microns. When the above thin toner layer is used for development, a stabilized developed image can be provided for a long period of time. Particularly, even if a vibration is imparted thereto, the magnetic particles can be confined within the developer container without leakage.

By the elastic member, the toner on the developing sleeve is sufficiently rubbed, and is uniformly and stably charged triboelectrically, and therefore, the present invention can be used when a small diameter developing sleeve (6–20 mm, for example) with which the time period for triboelectric charge application by the sleeve is small is used with good image development.

With those advantageous effects, a clear color image in a single chromatic color, in multi-color or in full-color can be formed.

Also, since the toner on the developing sleeve is rubbed with the elastic member, the toner receives triboelectric charge by the elastic member, and therefore, the triboelectric charge application to the toner by the magnetic particles can be reduced, correspondingly. Therefore, the amount of the magnetic particles in the developer container can be reduced.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus, comprising:
a rotatable member;
magnetic field generating means disposed in said rotatable member;
means for applying toner and magnetic particles on said rotatable member; and
toner layer forming means including an elastic member having a free end portion, adjacent to which it is contacted to said rotatable member and a magnetic member disposed at least adjacent the free end portion of said elastic member and disposed in a magnetic field provided by said magnetic field generating means.

2. An apparatus according to claim 1, wherein the free end portion of said elastic member is disposed upstream of a fixed end portion thereof with respect to a rotational direction of said rotatable member, and wherein at least a portion of a surface of the elastic member which is downstream of its free end is contacted to said rotatable member.

3. An apparatus according to claim 2, wherein said magnetic field generating means has a magnetic pole cooperable with said magnetic member to form a magnetic field, the magnetic pole being disposed at a position upstream of a free end of the elastic member with respect to a rotational direction of said rotatable member.

4. An apparatus according to claim 3, wherein said magnetic field generating means does not have any magnetic pole in the portion from a position where the elastic member is contacted to said rotatable member to a developing zone where the toner is supplied from the rotatable member to an image bearing member carrying an image to be developed.

5. An apparatus according to claim 2 or 3, wherein a leading edge of said magnetic member is disposed between a position 10 mm upstream of a free end of said elastic member and a position 5 mm downstream of the free end of said elastic member with respect to the rotational direction of said rotatable member.

6. An apparatus according to claim 2, 3 or 4, wherein said magnetic member is provided with a guiding surface for guiding the magnetic particles away from a free end of said elastic member.

7. An apparatus according to claim 1, 2, 3 or 4, wherein an average particle size of the magnetic particles is 30–200 microns.

8. An apparatus according to claim 7, wherein an average particle size of said magnetic particles is 40–70 microns.

9. An apparatus according to claim 7, wherein an average particle size of the toner is 5–20 microns.

10. An apparatus according to claim 1, 2, 3 or 4, wherein an average particle size of the toner is smaller than an average particle size of the magnetic particles.

11. An apparatus according to claim 1, 2, 3 or 4, wherein said elastic member is a non-magnetic rubber blade.

12. An apparatus according to claim 1, 2, 3 or 4, wherein said elastic member is a non-magnetic metal blade.

13. An apparatus according to claim 1, 2, 3 or 4, wherein said elastic member is a non-magnetic synthetic resin blade.

14. An apparatus according to claim 1, 2 or 3, further comprising means for forming a vibratory electric field in a developing zone.

15. A developing apparatus, comprising:
a rotatable member;
magnetic field generating means disposed in said rotatable member;
means for applying toner and magnetic particles on said rotatable member; and
toner layer forming means having an elastic member with a free end portion contacted to said rotatable member, wherein said free end portion of said elastic member is magnetic.

16. An apparatus according to claim 15, wherein the free end portion of said elastic member is disposed upstream of a fixed end portion thereof with respect to a rotational direction of said rotatable member, and wherein at least a portion of a surface of the elastic member which is downstream of its free end is contacted to said rotatable member.

17. An apparatus according to claim 16, wherein said magnetic field generating means has a magnetic pole cooperative with said elastic member to form a magnetic field, the magnetic pole being disposed upstream of the free end portion of said elastic member with respect to rotational direction of said rotatable member.

18. An apparatus according to claim 17, wherein said magnetic field generating means does not have any magnetic pole in the portion from a position where the elastic member is contacted to said rotatable member to a developing zone where the toner is supplied from the rotatable member to an image bearing member carrying an image to be developed.

19. An apparatus according to claim 16, 17 or 18, wherein said elastic member is a rubber blade into which magnetic material is mixed.

20. An apparatus according to claim 19, wherein said magnetic material provides magnetic anisotropy in a direction along magnetic lines of force extending from said magnetic field generating means.

21. An apparatus according to claim 16, 17 or 18, wherein said elastic member is a magnetic metal blade.

22. An apparatus according to claim 16, 17 or 18 further comprising a guiding member for guiding the magnetic particles away from the free end portion of said elastic member.

23. An apparatus according to claim 16, 17 or 18, wherein an average particle size of the magnetic particles is 30–200 microns.

24. An apparatus according to claim 23, wherein an average particle size of said magnetic particles is 40–70 microns.

25. An apparatus according to claim 23, wherein an average particle size of the toner is 5–20 microns.

26. An apparatus according to claim 16, 17 or 18, wherein an average particle size of the toner is smaller than an average particle size of the magnetic particles.

27. An apparatus according to claim any one of claims 15–18, further comprising means for forming a vibratory electric field in the developing zone.

* * * * *

UNITED STATES PATENT AND TRADEMARK OFFICE

CERTIFICATE OF CORRECTION

PATENT NO. : 4,876,574

DATED : October 24, 1989

INVENTOR(S) : HATSUO TAJIMA, ET AL.

It is certified that error appears in the above-identified patent and that said Letters Patent is hereby corrected as shown below:

COLUMN 3

Line 45, "make" should read --to make--.

COLUMN 5

Line 64, "creased, simultaneously," should read --creased. Simultaneously,--.

COLUMN 6

Line 14, "feed end" should read --free end--.

COLUMN 8

Line 42, "mixed" should read --are mixed--.
Line 57, "and" should be deleted.

COLUMN 11

Line 30, "is 250-350 mesh" should read --of 250-350 mesh--.
Line 49, "is" should read --are--.

COLUMN 12

Line 44, "when" should read --with--.

--

UNITED STATES PATENT AND TRADEMARK OFFICE

CERTIFICATE OF CORRECTION

PATENT NO. : 4,876,574

DATED : October 24, 1989

INVENTOR(S) : HATSUO TAJIMA, ET AL.

It is certified that error appears in the above-identified patent and that said Letters Patent is hereby corrected as shown below:

COLUMN 14

Line 32, "rotational direction" should read --the rotational direction--.
Line 49, "18" should read --18,--.
Line 64, "claim" should be deleted.

Signed and Sealed this

Twenty-eighth Day of April, 1992

*Attest:*

HARRY F. MANBECK, JR.

*Attesting Officer*

*Commissioner of Patents and Trademarks*